US011381012B2

(12) United States Patent
Wang et al.

(10) Patent No.: US 11,381,012 B2
(45) Date of Patent: Jul. 5, 2022

(54) ELECTRICAL CONNECTOR AND ELECTRICAL CONNECTOR ASSEMBLY

(71) Applicant: Tyco Electronics (Shanghai) Co. Ltd., Shanghai (CN)

(72) Inventors: Yunhe Wang, Shanghai (CN); Zhigang Song, Shanghai (CN); Peng Zhai, Shanghai (CN); Jiahui Chen, Shanghai (CN); Liyun Zhu, Shanghai (CN); Zifu Dai, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 16/986,991

(22) Filed: Aug. 6, 2020

(65) Prior Publication Data

US 2021/0057837 A1 Feb. 25, 2021

(30) Foreign Application Priority Data

Aug. 23, 2019 (CN) ..... 201910787572.1

(51) Int. Cl.
*H01R 13/71* (2006.01)
*H01R 12/71* (2011.01)
*H01R 13/17* (2006.01)

(52) U.S. Cl.
CPC ..... *H01R 12/714* (2013.01); *H01R 13/17* (2013.01)

(58) Field of Classification Search
CPC ... H01R 12/714; H01R 13/17; H01R 13/2421
USPC ..... 439/700, 824
See application file for complete search history.

(56) References Cited

U.S. PATENT DOCUMENTS 2,724,096 A * 11/1955 Klostermann ..... H01R 13/2421 439/824
3,639,892 A * 2/1972 Dill ..... H01R 13/53 439/607.01
4,904,213 A * 2/1990 Hock ..... G01R 1/067 439/482
6,776,668 B1 * 8/2004 Scyoc ..... H01R 13/2421 439/295
6,796,850 B2 * 9/2004 Matsui ..... H01R 13/2421 439/700
7,507,110 B1 * 3/2009 Yin ..... G01R 1/06722 439/482
7,749,032 B1 * 7/2010 Yin ..... H01R 13/2421 439/482
8,337,256 B1 * 12/2012 Lin ..... H01R 12/7094 439/700

(Continued)

*Primary Examiner* — Neil Abrams
(74) *Attorney, Agent, or Firm* — Barley Snyder

(57) ABSTRACT

An electrical connector includes a conductive housing having a first receiving portion with an open end, a movable terminal having a first end inserted into the first receiving portion via the open end, the movable terminal having a second receiving portion, and a first elastic piece located in a space defined by the first receiving portion and the second receiving portion. A second end of the movable terminal opposite to the first end protrudes movably out of the first receiving portion against an elasticity of the first elastic piece. The first end of the movable terminal has a first elastic arm elastically abutting an inner side wall of the first receiving portion. The movable terminal is electrically connected to the conductive housing by each of the first elastic piece and the first elastic arm.

19 Claims, 5 Drawing Sheets

(56) References Cited

U.S. PATENT DOCUMENTS

| | | | | |
|---|---|---|---|---|
| 10,535,942 | B2 * | 1/2020 | Sugiura | H01R 13/2421 |
| 10,790,624 | B2 * | 9/2020 | Wang | H01R 24/50 |
| 10,910,778 | B2 * | 2/2021 | Ni | H01R 24/50 |
| 2021/0057837 | A1 * | 2/2021 | Wang | H01R 13/17 |

* cited by examiner

ELECTRICAL CONNECTOR AND ELECTRICAL CONNECTOR ASSEMBLY

CROSS-REFERENCE TO RELATED APPLICATION

This application claims the benefit of the filing date under 35 U.S.C. § 119(a)-(d) of Chinese Patent Application No. 201910787572.1, filed on Aug. 23, 2019.

FIELD OF THE INVENTION

The present invention relates to an electrical connector and, more particularly, to an electrical connector with a movable terminal.

BACKGROUND

Some existing electrical connectors include a movable terminal placed in a receiving portion of a cylindrical conductive housing. An end of the movable terminal is located in the receiving portion and movably protrudes out of the receiving portion against elasticity of a spring so as to be electrically connected to a connection terminal.

The movable terminal is generally kept in contact with the conductive housing by a spring at one end thereof. However, such contact is not stable enough, particularly when there is a vibration or external force applied to the movable terminal, which results in poor contact between the movable terminal and the conductive housing, thereby generating high frequency resonance and current transient interruption.

SUMMARY

An electrical connector includes a conductive housing having a first receiving portion with an open end, a movable terminal having a first end inserted into the first receiving portion via the open end, the movable terminal having a second receiving portion, and a first elastic piece located in a space defined by the first receiving portion and the second receiving portion. A second end of the movable terminal opposite to the first end protrudes movably out of the first receiving portion against an elasticity of the first elastic piece. The first end of the movable terminal has a first elastic arm elastically abutting an inner side wall of the first receiving portion. The movable terminal is electrically connected to the conductive housing by each of the first elastic piece and the first elastic arm.

BRIEF DESCRIPTION OF THE DRAWINGS

The above and other features of the present disclosure will become more apparent by describing in detail exemplary embodiments thereof with reference to the accompanying drawings, in which.

DETAILED DESCRIPTION OF THE EMBODIMENT(S)

Figure 1:
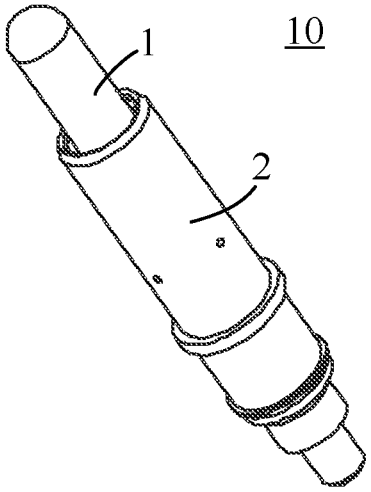
FIG. 1 is a perspective view of an electrical connector according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
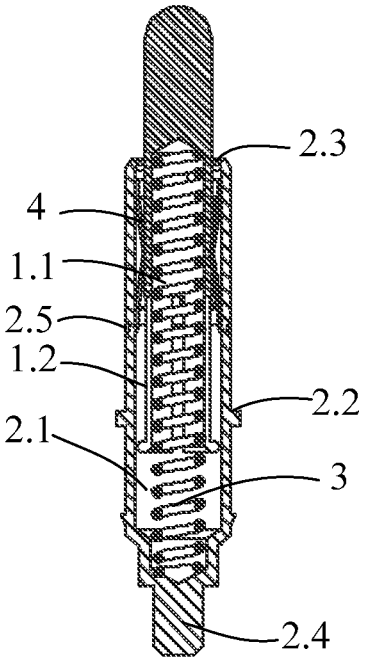
FIG. 2 is a sectional side view of the electrical connector.

An electrical connector 10 according to an embodiment, as shown in FIGS. 1 and 2, comprises a cylindrical conductive housing 2, a movable terminal 1, and a first elastic piece 3.

As shown in FIG. 2, a first cylindrical receiving portion 2.1 is formed in the conductive housing 2, the first receiving portion 2.1 having an open end, and an end of the first receiving portion 2.1 opposite to the open end being closed. A first end of the movable terminal 1 is inserted into the first receiving portion 2.1 via the open end of the first receiving portion 2.1, and a second receiving portion 1.1 is formed in the first end of the movable terminal 1. The first elastic piece 3 is located in a space defined by the first receiving portion 2.1 and the second receiving portion 1.1. A second end of the movable terminal 1 opposite to the first end protrudes movably out of the first receiving portion 2.1 against the elasticity of the first elastic piece 3 to be electrically connected to an electronic component (e.g., a PCB board).

As shown in FIG. 2, the first end of the movable terminal 1 is further formed with a plurality of first elastic arms 1.2. A notch 1.4, shown in FIG. 4, is arranged between two adjacent first elastic arms 1.2, and the first elastic arms 1.2 are configured to elastically abut against an inner side wall of the first receiving portion 2.1 so that the movable terminal 1 is electrically connected to the conductive housing 2 by the first elastic piece 3 and the first elastic arm 1.2, improving the connection reliability between the movable terminal 1 and the conductive housing 2.

Figure 4:
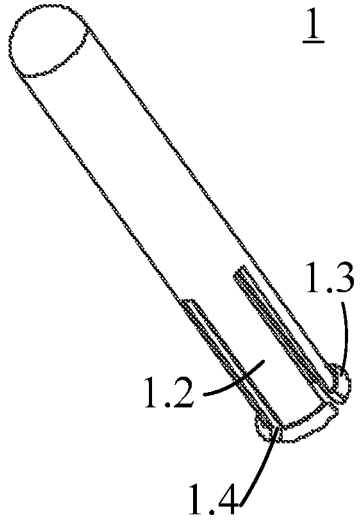
FIG. 4 is a perspective view of a movable terminal of the electrical connector.
Figure 5:
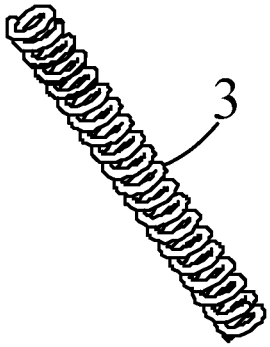
FIG. 5 is a perspective view of a first elastic piece of the electrical connector.

In an exemplary embodiment, as shown in FIGS. 2 and 4, each first elastic arm 1.2 extends from the first end of the movable terminal 1 in an axial direction of the movable terminal 1. In this way, the insertion of the movable terminal 1 into the first receiving portion 2.1 of the conductive housing 2 may be facilitated. It will be appreciated by those skilled in the art that in some other embodiments of the present disclosure, the first elastic arm 1.2 may also extend, for example, in a direction at an angle to the axial direction of the movable terminal 1, so as to be in electrical contact with the inner side wall of the first receiving portion 2.1.

In an exemplary embodiment, as shown in FIGS. 2 and 4, a free end of each first elastic arm 1.2 is provided with a protrusion 1.3 protruding radially and outwardly to be in elastic contact with the inner side wall of the conductive housing 2, so that the movable terminal 1 may be in reliable electrical contact with the conductive housing 2.

As shown in FIG. 4, the plurality of first elastic arms 1.2 are distributed at a regular interval in a circumferential direction of the movable terminal 1, thereby making it easy for the movable terminal 1 to be positioned at the center of the receiving portion 2.1 by an elastic force of the plurality of elastic arms 1.2. An axis of the movable terminal 1 coincides with an axis of the first receiving portion 2.1.

In an exemplary embodiment, as shown in FIG. 2, the electrical connector 10 includes a second elastic piece (e.g., a tube spring 4) provided between the inner side wall of the conductive housing 2 and the movable terminal 1. The movable terminal 1 may be electrically connected to the conductive housing 2 by the second elastic piece, so as to further improve the reliability of the electrical connection between the movable terminal 1 and the conductive housing 2. In an embodiment, the second elastic piece may replace the first elastic arm 1.2, i.e. the first end of the movable terminal 1 may not be provided with the first elastic arm and may be electrically connected to the conductive housing 2 by only the second elastic piece.

In an exemplary embodiment, as shown in FIG. 2, the tube spring 4 is located between the first end of the movable terminal 1 and the open end of the first receiving portion 2.1. The tube spring 4 is configured to elastically abut against an outer circumferential surface of the movable terminal 1 and the inner side wall of the conductive housing 2, so that the movable terminal 1 may be electrically connected to the conductive housing 2.

Figure 6:
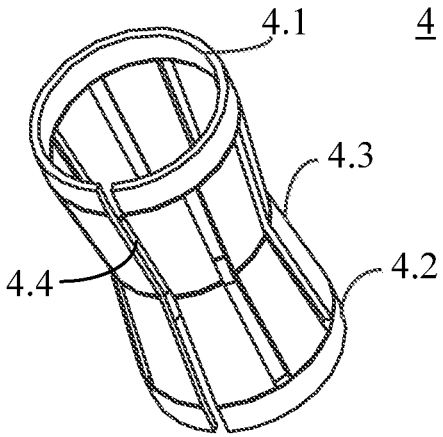
FIG. 6 is a perspective view of a tube spring of the electrical connector.

The tube spring 4, as shown in FIG. 6, includes a plurality of elastic sheets 4.3 distributed at a regular interval in a circumference direction of the tube spring 4. Each elastic sheet 4.3 axially extends from a pair of opposite ends 4.1, 4.2 of the tube spring 4 toward each other and is formed as a V-shaped structure protruding toward the movable terminal 1, so as to elastically abut against the outer circumferential surface of the movable terminal 1. The opposite ends 4.1, 4.2 of the tube spring 4 are in electrical contact with the inner side wall of the conductive housing 2, so that the movable terminal 1 is electrically connected to the conductive housing 2 by the tube spring 4. It will be appreciated for those skilled in the art that in other embodiments of the present disclosure, the spring sheets 4.3 may also be formed as an arc-shaped structure protruding toward the movable terminal 1, for example. Furthermore, the number of the spring sheets 4.3 may also be one.

Referring again to FIG. 6, the tube spring 4 has an open slot 4.4 extending axially through the ends 4.1, 4.2 of the tube spring 4. By providing the open slot 4.4, the range of deformation of the tube spring 4 may be made larger to be suitable for the first receiving portion 2.1 of different sizes (i.e., inner diameters) as much as possible.

In an exemplary embodiment, as shown in FIG. 2, the open end of the first receiving portion 2.1 is provided with a flange 2.3 protruding radially inwardly and adapted to prevent the tube spring 4 from sliding out of the first receiving portion 2.1, and the first receiving portion 2.1 is also formed with at least one stopping portion 2.5 adapted to prevent the tube spring 4 from moving away from the open end of the first receiving portion 2.1. In this way, the position of the tube spring 4 in the axial direction of the conductive housing 2 may be defined or limited by the flange 2.3 and the stopping portion 2.5.

Figure 3:
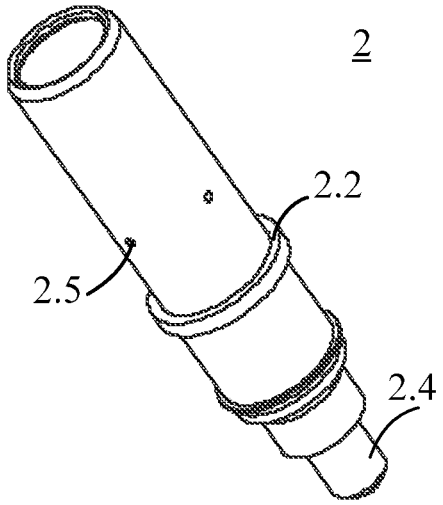
FIG. 3 is a perspective view of a conductive housing of the electrical connector.

In an exemplary embodiment, as shown in FIGS. 2 and 3, the stopping portion 2.5 is a recess formed in the side wall of the first receiving portion 2.1. It will be appreciated by those skilled in the art that in some other embodiments of the present disclosure, the stopping portion 2.5 may also be a protrusion protruding radially inwardly from the inner side wall of the first receiving portion 2.1.

Figure 8:
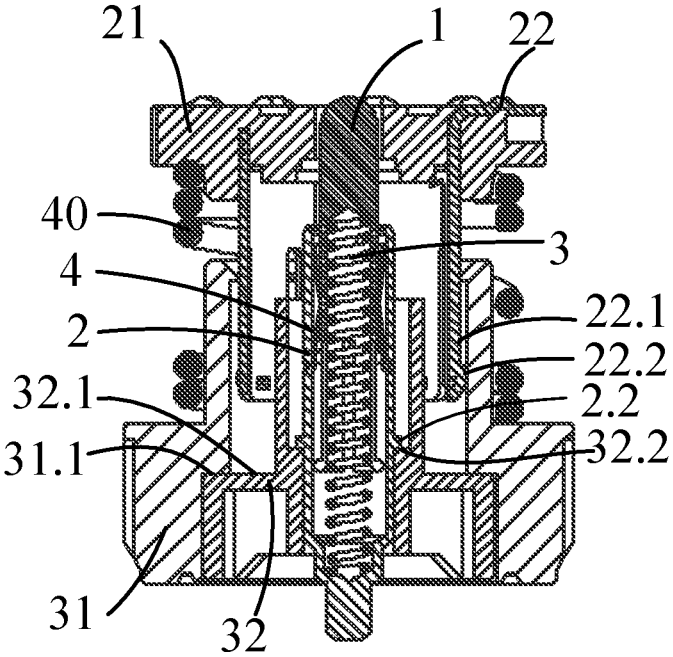
FIG. 8 is a sectional side view of the electrical connector assembly.

In an exemplary embodiment, as shown in FIGS. 1, 2 and 3, a first protrusion 2.2 is formed on an outer side wall of the first receiving portion 2.1 and protrudes radially outwardly so as to fix an insulation cylinder 32 of an electrical connector assembly 100 (shown in FIG. 8).

As shown in FIGS. 1, 2 and 3, the first receiving portion 2.1 has the open end, and the end (i.e., a closed end) of the first receiving portion 2.1 opposite to the open end is formed with an extension portion 2.4 extending away from the open end. In this case, the electrical connector 10 comprises one movable terminal 1, the first end of the terminal 1 protruding from the open end of the first receiving portion 2.1 to be in electrical contact with an electronic component 300 (shown in FIG. 9). However, it will be appreciated by those skilled in the art that in some other embodiments of the present disclosure, two opposite ends of the first receiving portion 2.1 may be open. In this case, the electrical connector 10 may comprises two movable terminals 1, the first ends of the two movable terminals 1 protruding from the two opposite ends of the first receiving portion 2.1 to be in electrical contact with the corresponding electronic components, respectively. The first elastic piece 3 is located in a space defined by the first receiving portion 1.2 and the second receiving portion 2.1 of the two movable terminals 1.

It will be appreciated by those skilled in the art that in some other embodiments of the present disclosure, the number of the first elastic arms 1.2 may be one. Further, the second elastic piece may also in other forms, for example in a form of a plurality of elastic arms integrally connected to the conductive housing 2, the plurality of elastic arms comprising an arc-shaped structure protruding from the inner side surface of the conductive housing 2 toward the movable terminal 1 to be in elastic contact with the movable terminal 1.

Figure 7:
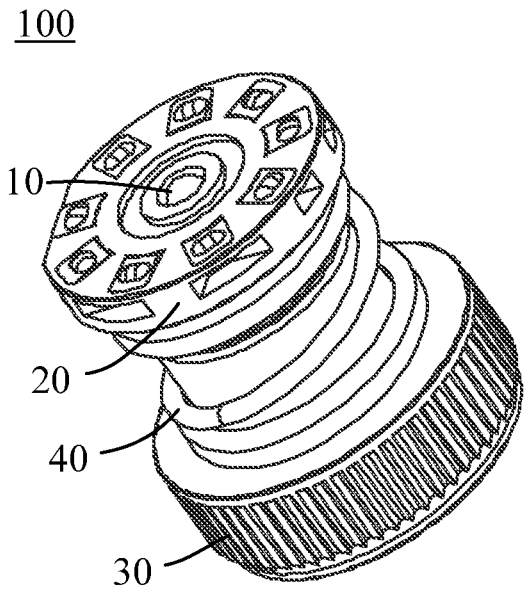
FIG. 7 is a perspective view of an electrical connector assembly according to an embodiment.

According to an embodiment of another aspect of the present disclosure, there is provided an electrical connector assembly 100. As shown in FIGS. 7 and 8, the electrical connector assembly 100 comprises the electrical connector 10 as described above in any one embodiment and a cylinder 30 comprising an outer conductive cylinder 31 and an inner insulation cylinder 32. The inner insulation cylinder 32 is provided in the outer conductive cylinder 31, and the electrical connector 10 is mounted in the inner insulation cylinder 32 and isolated from the outer conductive cylinder 31 by the inner insulation cylinder 32.

As shown in FIGS. 7 and 8, the electrical connector assembly comprises a mating connector 20 including an insulation base 21 and a connection terminal 22 connected to the insulation base 21. The connection terminal 22 extends partially into the outer conductive cylinder 31 and is electrically connected to the outer conductive cylinder 31.

In some exemplary embodiments, as shown in FIG. 8, an end of the connection terminal 22 extending into the outer conductive cylinder 31 is formed with at least one second elastic arm 22.1, which is configured to elastically abut against an inner side wall of the outer conductive cylinder 31 to be electrically connected to the outer conductive cylinder 31. Each of the at least one second elastic arms 22.1 extends from the outer conductive cylinder 31 in an axial direction of the outer conductive cylinder 31. In this way, insertion of the mating connector 20 into the outer cylinder 31 may be facilitated. It will be appreciated by those skilled in the art that in other embodiments of the present disclosure, the second elastic arms 22.1 may also extend in a direction at an angle to the axial direction of the outer conductive cylinder 31, for example, so as to elastically abut against the inner side wall of the outer conductive cylinder 31.

In some exemplary embodiments, as shown in FIG. 8, an free end of each second elastic arms 22.1 is provided with a second protrusion 22.2 protruding toward the outer conductive cylinder 31 to be in elastic contact with the outer conductive cylinder 31, which may enable the mating connector 20 to be in reliable electric contact with the outer conductive cylinder 31.

In some exemplary embodiments, as shown in FIG. 8, the outer side wall of the inner insulation cylinder 32 is formed with a first step 32.1, and the inner side wall of the outer conductive cylinder 31 is formed with a second step 31.1, the first step 32.1 abutting against the second step 31.1 to limit a axial movement of the inner insulation cylinder 32 toward the mating connector 20. The inner side wall of the inner insulation cylinder 32 may also be formed with a third step 32.2, the first protrusion 2.3 of the conductive housing 2 abutting against the third step 32.2 to limit the axial movement of the inner insulation cylinder 32 toward the mating connector 20.

Figure 9:
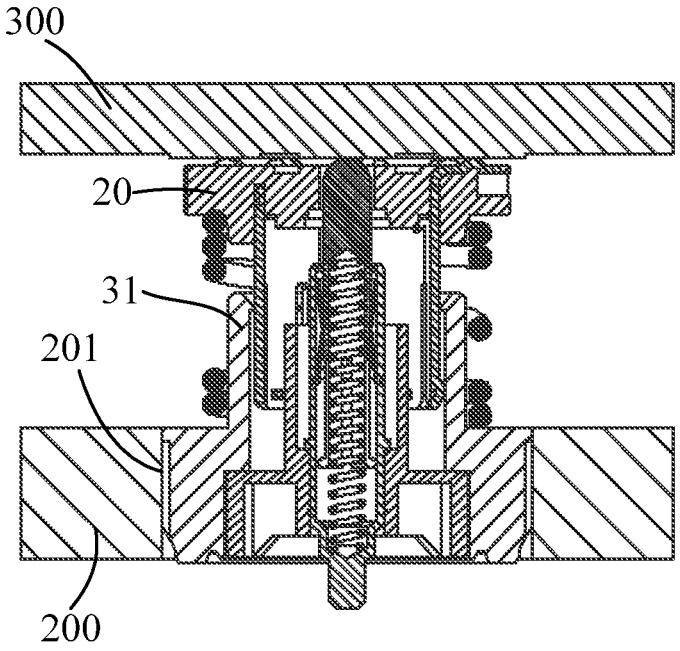
FIG. 9 is a sectional side view of an electrical component according to an embodiment.
Figure 10:
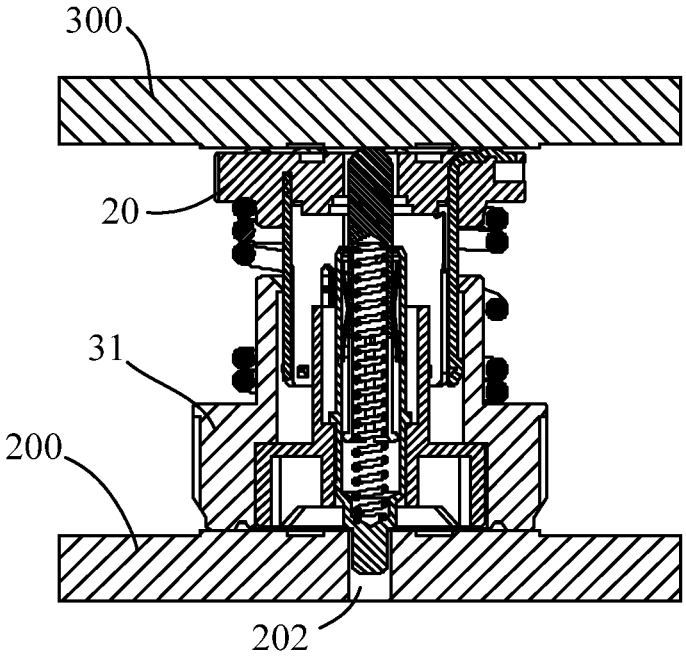
FIG. 10 is a sectional side view of an electrical component according to another embodiment.

In some exemplary embodiments, as shown in FIGS. 7 and 8, the electrical connector assembly 100 includes a third elastic piece 40, such as a spring, two ends of the third elastic piece 40 elastically abutting against the insulating base 21 and the outer conductive cylinder 31, respectively, so that a pressing force can be provided by the third elastic piece 40 to ensure an electrical connection with an first electronic assembly 300 (e.g., PCB board) at an upper end of the electrical connector assembly 100 and an electrical connection with an second electronic assembly 200 (e.g., PCB board, filter) at an lower end of the electrical connector assembly 100, respectively, as shown in FIGS. 9 and 10.

As shown in FIGS. 9 and 10, the electrical component comprises an electrical connector assembly 100 as described above and an electronic component 200, the outer conductive cylinder 31 of the electrical connector assembly 100 being electrically connected to the electronic component 200.

In some exemplary embodiments, as shown in FIG. 9, the electronic component 200 has a mounting hole 201, and one end of the outer conductive cylinder 31 facing away from the first receiving portion 2.1 of the electrical connector 10 may be mounted in the mounting hole 201 by pressing or screwing, for example, so as to be in electrical contact with an inner side wall of the mounting hole 201.

In some exemplary embodiments, as shown in FIG. 10, an end of the outer conductive cylinder 31 facing away from the first receiving portion 2.1 of the electrical connector 10 is soldered on the electronic component 200 to be in electric contact with the electronic component 200. In the embodiment shown in FIG. 10, the electronic component 200 is provided with a through hole 202 into which the extension portion 2.4 of the conductive housing 2 of the electrical connector 10 is inserted.

According to the electrical connector 10 and the electrical connector assembly 100 described in various embodiments of the present disclosure, at least one first elastic arm 1.2 is provided at the first end of the movable terminal 1 and elastically abuts against the inner side wall of the first receiving portion 2.1, so that the movable terminal 1 is electrically connected to the conductive housing 2 by the first elastic arm 1.2 and the first elastic piece 3 located at the first end of the movable terminal 2, thereby improving the reliability of electrical contact. The movable terminal 1 may be kept in electrical contact with the conductive housing 2 by the first elastic piece 3 and the first elastic arm 1.2 even in the event of vibration or external force applied to the movable terminal 1, thereby avoiding the occurrence of high frequency resonance and current transient interruption and improving a working range. In addition, the conductive housing 2 and the tube spring 4 may be formed by a stamping process, thereby reducing the manufacturing cost.

It will be understood by those skilled in the art that the above-described embodiments are exemplary and that modifications may be made by those skilled in the art, and that structures described in the various embodiments may be freely combined without conflict in structure or principle. Although the embodiments of the present disclosure have been described in detail, it will be apparent to those skilled in the art that various changes and modifications can be made without departing from the scope and spirit of the appended claims, and the disclosure is not limited to the exemplary embodiments illustrated in the specification.

What is claimed is:

1. An electrical connector, comprising:

a conductive housing having a first receiving portion with an open end;

a movable terminal having a first end inserted into the first receiving portion via the open end, the movable terminal having a second receiving portion;

a first elastic piece located in a space defined by the first receiving portion and the second receiving portion, a second end of the movable terminal opposite to the first end protrudes movably out of the first receiving portion against an elasticity of the first elastic piece, the first end of the movable terminal has a first elastic arm elastically abutting an inner side wall of the first receiving portion, the movable terminal being electrically connected to the conductive housing by each of the first elastic piece and the first elastic arm; and a second elastic piece provided between the inner side wall and the movable terminal and located between the first end of the movable terminal and the open end of the first receiving portion, the second elastic piece having a spring sheet extending axially from a pair of opposite ends thereof toward each other, the spring sheet has a structure protruding toward the movable terminal, the movable terminal is electrically connected to the conductive housing by the second elastic piece.

2. The electrical connector according to claim 1, wherein the first elastic arm extends from the first end of the movable terminal in an axial direction of the movable terminal.

3. The electrical connector according to claim 1, wherein a free end of the first elastic arm has a protrusion protruding radially outwardly and in elastic contact with the conductive housing.

4. The electrical connector according to claim 1, wherein the second elastic piece is a tube spring.

5. The electrical connector according to claim 4, wherein the spring sheet has an arc-shaped or a V-shaped structure.

6. The electrical connector according to claim 5, wherein the tube spring has an open slot extending axially through the pair of opposite ends of the tube spring.

7. The electrical connector according to claim 4, wherein the open end of the first receiving portion has a flange protruding radially inwardly and preventing the tube spring from sliding out of the first receiving portion, the first receiving portion has a stopping portion preventing the tube spring from moving away from the open end of the first receiving portion.

8. The electrical connector according to claim 1, wherein an outer side wall of the first receiving portion has a first protrusion protruding radially outwardly.

9. The electrical connector according to claim 1, wherein an end of the first receiving portion opposite to the open end has an extension portion extending away from the open end.

10. An electrical connector, comprising:

a conductive housing having a first receiving portion with an open end;

a movable terminal having a first end inserted into the first receiving portion via the open end, the movable terminal having a second receiving portion;

a first elastic piece located in a space defined by the first receiving portion and the second receiving portion, a second end of the movable terminal opposite to the first end protrudes movably out of the first receiving portion against an elasticity of the first elastic piece; and a second elastic piece provided between an inner side wall of the conductive housing and the movable terminal and located between the first end of the movable terminal and the open end of the first receiving portion, the second elastic piece having a spring sheet extending axially from a pair of opposite ends thereof toward each other, the movable terminal is electrically connected to the conductive housing by the second elastic piece.

11. The electrical connector according to claim 10, wherein the second elastic piece is a tube spring.

12. The electrical connector according to claim 10, wherein the spring sheet has an arc-shaped or a V-shaped structure protruding toward the movable terminal.

13. The electrical connector according to claim 12, wherein the tube spring has an open slot extending axially through the pair of opposite ends of the tube spring.

14. An electrical connector assembly, comprising:

an electrical connector including a conductive housing having a first receiving portion with an open end, a movable terminal having a first end inserted into the first receiving portion via the open end, the movable terminal having a second receiving portion, and a first elastic piece located in a space defined by the first receiving portion and the second receiving portion, a second end of the movable terminal opposite to the first end protrudes movably out of the first receiving portion against an elasticity of the first elastic piece, the first end of the movable terminal has a first elastic arm elastically abutting an inner side wall of the first receiving portion, the movable terminal being electrically connected to the conductive housing by each of the first elastic piece and the first elastic arm;

a cylinder including an outer conductive cylinder and an inner insulation cylinder provided in the outer conductive cylinder, the electrical connector is mounted in the inner insulation cylinder and isolated from the outer conductive cylinder by the inner insulation cylinder; and a mating connector including an insulation base and a connection terminal connected to the insulation base, the connection terminal extending partially into the outer conductive cylinder and electrically connected to the outer conductive cylinder.

15. The electrical connector assembly according to claim 14, wherein an end of the connection terminal extending into the outer conductive cylinder has a second elastic arm elastically abutting against an inner side wall of the outer conductive cylinder.

16. The electrical connector assembly according to claim 15, wherein the second elastic arm extends from the outer conductive cylinder in an axial direction of the outer conductive cylinder.

17. The electrical connector assembly according to claim 16, wherein a free end of the second elastic arm has a second protrusion protruding towards the outer conductive cylinder and in elastic contact with the outer conductive cylinder.

18. The electrical connector assembly according to claim 14, wherein:

an outer side wall of the inner insulation cylinder has a first step and an inner side wall of the outer conductive cylinder has a second step, the first step abutting the second step to limit an axial movement of the inner insulation cylinder toward the mating connector; and/or an inner side wall of the inner insulation cylinder has a third step, the first protrusion of the conductive housing abuts against the third step to limit the axial movement of the inner insulation cylinder toward the mating connector.

19. An electrical connector, comprising:

a conductive housing having a first receiving portion with an open end;

a movable terminal having a first end inserted into the first receiving portion via the open end, the movable terminal having a second receiving portion;

a first elastic piece located in a space defined by the first receiving portion and the second receiving portion, a second end of the movable terminal opposite to the first end protrudes movably out of the first receiving portion against an elasticity of the first elastic piece, the first end of the movable terminal has a first elastic arm elastically abutting an inner side wall of the first receiving portion, the movable terminal being electrically connected to the conductive housing by each of the first elastic piece and the first elastic arm; and a tube spring provided between the inner side wall and the movable terminal and located between the first end of the movable terminal and the open end of the first receiving portion, the movable terminal is electrically connected to the conductive housing by the tube spring, the open end of the first receiving portion has a flange protruding radially inwardly and preventing the tube spring from sliding out of the first receiving portion, the first receiving portion has a stopping portion preventing the tube spring from moving away from the open end of the first receiving portion.

* * * * *